US010202254B2

(12) United States Patent
Maleck et al.

(10) Patent No.: US 10,202,254 B2
(45) Date of Patent: Feb. 12, 2019

(54) METHOD FOR EXTRACTING A THREAD BY SUCTION FROM A BOBBIN AND A CORRESPONDING SYSTEM

(71) Applicant: Rieter Ingolstadt GmbH, Ingolstadt (DE)

(72) Inventors: Mario Maleck, Walting (DE); Thomas Gruber, Ingolstadt (DE); Robin Wein, Ingolstadt (DE); Christian Kettner, Koesching (DE); Robert Hagl, Rottenegg (DE); Romeo Pohn, Geisenfeld/Rottenegg (DE)

(73) Assignee: Rieter Ingolstadt GmbH, Ingolstadt (DE)

( * ) Notice: Subject to any disclaimer, the term of this patent is extended or adjusted under 35 U.S.C. 154(b) by 302 days.

(21) Appl. No.: 15/224,604

(22) Filed: Jul. 31, 2016

(65) Prior Publication Data

US 2017/0029235 A1 Feb. 2, 2017

(30) Foreign Application Priority Data

Jul. 31, 2015 (DE) ..... 10 2015 112 660

(51) Int. Cl.
*B65H 67/08* (2006.01)
*D01H 4/50* (2006.01)

(52) U.S. Cl.
CPC ..... *B65H 67/085* (2013.01); *D01H 4/50* (2013.01); *B65H 2701/31* (2013.01)

(58) Field of Classification Search
CPC ..... B65H 67/085
See application file for complete search history.

(56) References Cited

U.S. PATENT DOCUMENTS 3,754,718 A * 8/1973 Abbott ..... B65H 67/085 242/476
3,866,848 A * 2/1975 Abbott ..... B65H 67/085 242/476

(Continued)

FOREIGN PATENT DOCUMENTS

DE 10 2011 053 813 A1 3/2013
DE 10 2013 102 770 A1 9/2014

(Continued)

OTHER PUBLICATIONS

German Search Report, dated Jun. 9, 2016.
EP Search Report, dated Feb. 7, 2017.

*Primary Examiner* — Shaun R Hurley
(74) *Attorney, Agent, or Firm* — Dority & Manning, P.A.

(57) ABSTRACT

A system and associated operational method are provided to extract a thread by suction from a bobbin and for re-attachment of a thread end of the thread to a new thread. The thread is extracted from the bobbin by sucking the thread in against its spooling direction on the bobbin through a suction nozzle and into an extraction port of an extraction system. A loop is subsequently formed in the thread, and the thread is separated in the area of the loop. One thread end of the separated thread is discharged into an extraction port, and the other thread end coming from the bobbin is prepared for re-attachment to a new thread. Upon being extracted by suction into the extraction system, the thread is guided through an eyelet located in a run of the thread to the extraction port and the eyelet, together with the thread, is moved out of the run of the thread to the extraction port such that the thread forms the loop between the bobbin, the eyelet, and the extraction port.

23 Claims, 7 Drawing Sheets

(56) References Cited

U.S. PATENT DOCUMENTS

| | | | | |
|---|---|---|---|---|
| 5,056,728 | A * | 10/1991 | Scaglia | B65H 67/08 226/97.4 |
| 5,862,660 | A * | 1/1999 | Haasen | B65H 63/06 242/475.1 |
| 8,915,055 | B2 | 12/2014 | Stephan et al. | |
| 9,353,463 | B2 | 5/2016 | Stahlecker et al. | |
| 2014/0283496 | A1 * | 9/2014 | Stahlecker | D01H 4/48 57/263 |
| 2017/0081142 | A1 * | 3/2017 | Maleck | B65H 51/10 |

FOREIGN PATENT DOCUMENTS

| | | |
|---|---|---|
| EP | 1 283 288 A2 | 2/2003 |
| EP | 2 444 347 A2 | 4/2012 |

* cited by examiner

METHOD FOR EXTRACTING A THREAD BY SUCTION FROM A BOBBIN AND A CORRESPONDING SYSTEM

FIELD OF THE INVENTION

The invention relates to a method for extracting a thread by suction from a bobbin and for the re-attachment of a thread end to a new thread, whereas the thread is sucked in against its spooling direction through a suction nozzle into an extraction system, a loop is subsequently formed. The thread is separated in the area of the loop, which discharges a thread end in the extraction port and prepares the other thread end coming out of the bobbin for re-attachment, and is subsequently attached to a new thread. The invention also relates to a device for extracting a thread by suction from a bobbin and for the re-attachment of a thread end to a new thread, with a suction nozzle, an extraction system, a device for forming a loop, a thread separating device and a thread preparation device.

BACKGROUND

A spinning device of an open-end rotor spinning machine is known from EP 1 283 288 A2. A thread is spun in an open-end spinning device and is delivered to a winding device. For the defined laying of the delivered thread on a bobbin, a single motor-driven thread traversing device is provided. After a thread breakage, the thread end that thereby arises is wound onto the bobbin. In order to use this thread end for the re-attachment with a new thread, it must be sought out on the bobbin. For this purpose, a swivel-mounted suction nozzle that is subject to negative pressure is provided. In the event of a thread breakage, the suction nozzle swivels from a lower position upwards to the bobbin circumference of the bobbin and subjects the bobbin surface to suction. The bobbin is set in a rotational movement, such that, after a certain period of time, the thread end is captured by the suction nozzle and extracted by suction. Subsequently, additional operations take place in order to be able to use the thread end for re-attachment. For this purpose, the thread end is transferred by the suction nozzle to other devices. This approach is time-consuming, since the suction nozzle must first be placed in motion, and the thread end that is found must be transferred by corresponding movements to the other operation devices. In addition, the structural complexity and the required installation space are considerable.

SUMMARY

Thus, a task of this invention is being able to carry out a simple and rapid re-attachment of a thread end to a new thread. Additional objects and advantages of the invention will be set forth in part in the following description, or may be obvious from the description, or may be learned through practice of the invention.

The tasks are solved with a method and a device with the characteristics described and claimed herein.

With the method in accordance with the invention for extracting a thread by suction from a bobbin and the re-attachment of a thread end to a new thread, the thread is sucked in against its spooling direction through a suction nozzle into an extraction system. Subsequently, a loop is formed, and the thread is separated in the area of the loop. The one thread end is discharged into the extraction port, and the other thread end coming from the bobbin is prepared for re-attachment and subsequently attached to a new thread. In accordance with the invention, upon being extracted by suction, the thread is guided through an eyelet located in the run of the thread of the extraction port, and the eyelet is, together with the thread, moved out of the run of the thread of the extraction port, such that the thread forms a loop between the bobbin, the eyelet and the extraction port.

With the method in accordance with the invention, upon extracting by suction and rewinding, the thread end is taken from the bobbin into the eyelet, in order to thus be able to form a loop. The loop is moved out of the run of the thread that is led back with the eyelet, and is stretched until it is in a position in which the thread can be further treated. Such further treatment takes place, for example, through separating of the thread, such that the one end can be used for re-attachment, while the other end is discharged into the extraction port. Through the largely automatic threading of the thread into the eyelet, the handling is greatly simplified and can be carried out quickly and reliably.

In a preferred version of the method, the movement of the eyelet is produced through a swiveling movement and/or a displacement along a guide. In this case, it is located, on the one hand, in the suction nozzle, in particular while the thread is rewound and threaded into the eyelet. As soon as the thread is located in the eyelet, it is moved out of the suction nozzle and moved to a location at which the further treatment of the thread may take place. The movement of the suction nozzle can be produced by swiveling a holder to which the eyelet is attached. Alternatively or additionally, the eyelet may also be moved or displaced along a guide, by which simple linear, but also more complex, movements may be generated.

In a particularly advantageous version of the invention, the eyelet is located within the suction nozzle during the threading of the thread. In order to not reduce the effectiveness of the suction nozzle, in an advantageous version of the method in accordance with the invention, it is provided that the eyelet or the components arranged thereon, during the extracting of the thread by suction, seal the suction nozzle at least temporarily. Thus, if the eyelet is located inside the suction nozzle, an optimal negative pressure is applied at the mouth of the suction nozzle, in order to be able to locate and extract by suction the thread end at the bobbin surface.

In order to form the loop, it is advantageously provided that the thread is pulled over at least one edge, preferably two edges. Together with the eyelet, such edges define the position of the loop. It is thereby possible that additional handling devices, such as, for example, a separating device or a thread preparation device, may be selectively brought into contact with the loop.

If, during the extracting of the thread by suction through the eyelet, the eyelet is located on one side of at least one edge and, during the forming of the loop, it is located on the other side of the at least one edge, the thread is pulled over such edge if the eyelet moves back from the one side to the other side of the edge. Thus, the loop is formed in a defined manner, and subsequently may be further treated selectively.

In order to be able to predetermine the position of the thread or the loop, it is provided that the thread is guided transverse to the movement of the eyelet by means of the eyelet into at least one predetermined position. This may take place by means of inclined guides within the eyelet or grooves located therein. The thread, which is wound crosswise onto the bobbin and is found in an unpredictable position on the surface of the bobbin, is thereby brought into a predetermined position, in order to selectively use the additional handling devices.

If, upon the extracting of the thread by suction, the eyelet guides the thread into a first position, and, upon forming the loop, in particular upon the swiveling and/or displacement of the eyelet, guides it into a second position, this measure also assists in positioning the thread or the loop in a defined manner, and being able to transfer it to additional handling devices, or being able to take it into a suitable position for re-attaching or connecting it to a new thread end.

If, with a particularly advantageous version of the invention, the thread is guided adjacent to the eyelet through a multi-valve, a loop may be formed optionally upon the extracting of the thread by suction or upon the re-attachment of the thread. In this case the multi-valve is switched in such a manner that it opens or closes suction tube ports or runs of the thread.

In order to always be able to handle the thread or the thread end in a guided manner, the thread end coming from the bobbin is clamped between the delivery rollers at the latest immediately after the separation. The delivery rollers may be selectively moved in the delivery direction of the thread or opposed to it, for the return delivery of the thread. Thus, it is possible to return the thread into them, for example, upon being attached in a spinning position, or to withdraw the thread from the spinning position after re-attachment and to deliver it to the bobbin.

If, upon extraction by suction from the bobbin and upon delivery to the bobbin, the thread is guided by the suction nozzle (which, in particular, is fixed), the suction nozzle need not be moved, and thus successfully contributes to a fast and simple finding of the thread end on the surface of the bobbin and the re-attachment of the thread end to a new thread.

A system in accordance with the invention for extracting a thread by suction from a bobbin and for re-attaching a thread end to a new thread comprises a suction nozzle for picking up a thread from the bobbin, an extraction system for extracting by suction the thread counter to its spooling direction into the extraction system, a device for forming a loop, a thread separating device for being able to separate the thread in the area of the loop and a thread preparation device for being able to prepare the thread for re-attachment. The re-attachment of a thread end to a new thread may occur, for example, in a spinning device, such as an open-end rotor spinning device. Alternatively, it is also possible to use the device upon re-attachment to a winding machine, with which an existing thread is connected to the thread end that has been picked up from the bobbin surface, for example by means of a splicing device. The thread preparation device may operate, for example, pneumatically or mechanically, and accordingly prepare the thread end, in order to be able to carry out the re-attachment successfully and with high quality.

If the system in accordance with the invention features an eyelet arranged in the run of the thread of the extraction port, in particular in the suction nozzle, in order to be able to guide the thread through it upon the extraction by suction, the thread is threaded into the eyelet already upon the extraction of the thread end by suction from the bobbin surface, and thus may be further treated without being transferred to an additional handling device. In this manner, a rapid and safe handling of the thread is ensured, as there need not be any transfers, with which defects may arise.

The eyelet is arranged on a movable holder, in order to be able to move it, together with the thread, from the run of the thread of the extraction port. In this manner, the thread forms a loop between the bobbin, the eyelet and the extraction port. In this loop, additional handling devices, such as a separating device, may intervene in order to be able to carry out the further handling of the thread up to its re-attachment.

Most preferably, the holder is mounted in a manner that it is able to be swiveled and/or displaced, together with the eyelet. Thereby, the eyelet can be moved out of the suction nozzle with a simple movement, and may span the thread in such a manner that a loop is formed. In this case, the swivel movement may guide the thread from the suction nozzle to the thread preparation device and the thread separating device. Thus, the handling of the thread up to its re-attachment takes place rapidly and without any error. For simple linear, but also more complex, movements of the eyelet, in particular for turning the eyelet, the holder may be mounted in a displaceable manner. Thereby, a space-saving guiding of the eyelet may take place.

If, in an advantageous form of the invention, the holder is guided in a slide, the holder and thus the eyelet can selectively perform movements that are particularly suitable for handling the thread and, with respect to the path, are optimally adjusted to the circumstances of the work location. If the holder is carried out in an articulated manner, it may cover the work area as a type of shutter when it enters the suction nozzle.

In order to allow the suction nozzle to work as effectively as possible, that is, so that the negative pressure applies at the bobbin surface as strongly as possible, and the thread end can be pulled off the bobbin surface and conveyed into the extraction port, it is advantageous if the eyelet arranged on the suction nozzle and/or components connected to it seals the suction nozzle upon extracting the thread by suction, at least temporarily. The suction nozzle, which preferably features an opening in which the eyelet can dip, thus becomes a suction channel, which preferably leads directly into the extraction port, whereas, however, the eyelet is located within the suction channel, such that the sucked-in thread is guided through the eyelet.

If at least one edge, preferably two edges, is located adjacent to the eyelet, the thread may be formed into a loop in a largely defined position. In addition, it is also achieved that a certain retaining force is generated, in order to keep the loop taut.

If, upon extracting the thread by suction through the eyelet, the eyelet is arranged on one side of the at least one edge, and if, on the other hand, the eyelet upon forming the loop is arranged on the other side of the at least one edge, the thread is pulled over this edge through the movement of the eyelet from the extraction channel. In this manner, both the position and the tension of the thread may be optimally formed.

If the eyelet features guides in order to be able to guide the thread into at least one predetermined position transverse to the movement of the eyelet, the thread or the loop may be positioned very accurately. This is advantageous, since, under certain circumstances, the thread preparation device or the thread separating device may be arranged in a stationary manner, and the thread is thereby always positioned in a defined position of the eyelet.

If one of the guides is arranged on the inner side of the eyelet and the other guide is arranged on the outer side of the eyelet, the thread is guided, in particular upon a swiveling movement of the eyelet, through both guides, and forms a stretched loop. Additional handling devices, for example, the thread separating device, may be introduced between the loop. Thus, the thread segment running up to the bobbin may be separated from the thread segment that is guided into the extraction port, and separately processed.

If a multi-way valve subjected to suction is arranged adjacent to the eyelet, optionally, a loop can be produced upon extraction by suction or upon re-attachment of the thread. Various suction ports are arranged in the multi-valve. During the formation of a loop upon extracting the thread by suction from the bobbin surface, the thread end that is to be discharged is introduced into the suction port. However, upon re-attaching the thread, it may be necessary that a thread loop of the thread delivered to the bobbin is produced, in order to be able to compensate for certain differences in length. In this case, it is advantageous if a thread loop is introduced into the other suction port. After re-attaching the thread, in the normal case, it is no longer necessary to form this loop. It may be released, and the thread proceeds in the normal delivery direction to the bobbin.

More preferably, the multi-valve comprises two tubes that are fitted into one another, are rotatable and feature slots. By the twisting of the two tubes relative to another, the slots may be opened or covered, and/or the suction tube ports may be opened or closed.

If the outer tube of the multi-valve features one, preferably two, suction ports, they may be opened or closed through the inner tube, depending on their rotational position.

If one of the suction ports provides for the fact that the thread is to be picked up from the bobbin upon the extraction by suction, and the other suction port provides for the fact that the thread is to be picked up upon the delivery to the bobbin, the multi-valve may assume various functions that are advantageous upon both the re-attachment and the spinning of the thread.

If the multi-valve and the slots are arranged in such a manner that the thread proceeds through the slots upon delivery to the bobbin, the handling of the thread upon its re-attachment is particularly simple to carry out. In this case, the multi-valve always remains in the area of the run of the thread and is therefore readily accessible for use.

BRIEF DESCRIPTION OF THE DRAWINGS

Further advantages of the invention are described in the following embodiments. The following is shown.

DETAILED DESCRIPTION

Figure 1C:
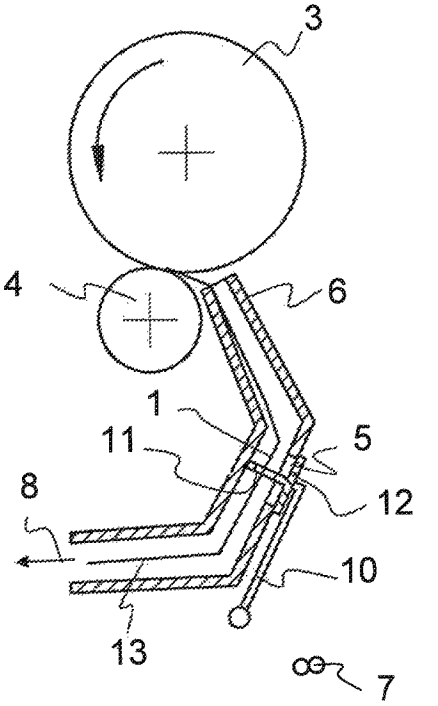
FIG. 1*c* depicts a thread threaded into the eyelet.
Figure 1C:
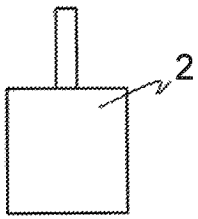

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

Figure 1B:
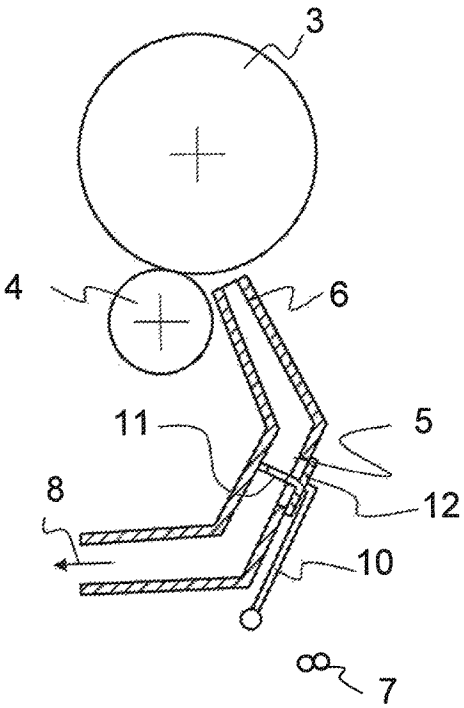
FIG. 1*b* depicts an eyelet swung into the suction nozzle.
Figure 1B:
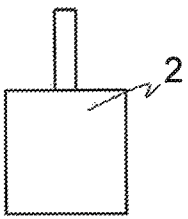
Figure 1A:
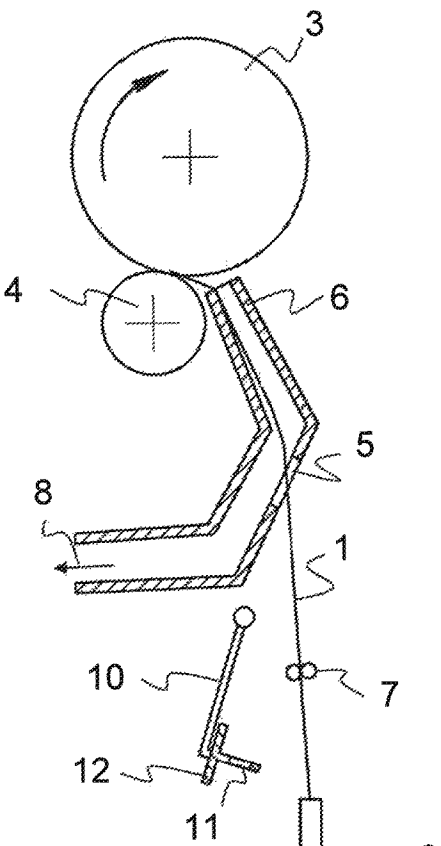
FIG. 1*a* depicts the delivery of a thread from a spinning position to a bobbin.
Figure 1A:
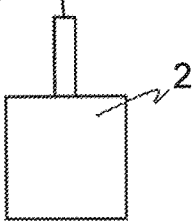

FIG. 1*a* shows a run of the thread of a thread 1 from a spinning position 2 to a bobbin 3. The bobbin 3 is driven by means a winding roller 4 in the direction of the arrow. In the spinning position 2, a thread is produced; this is subsequently wound onto the bobbin 3. Instead of the spinning position 2, the described device can also be used in winding machines with which the thread of a ring spinning bobbin is unwound and is wound crosswise onto the bobbin 3.

From FIG. 1*a*, it can be seen that the thread 1 enters and passes through an opening 5 of a suction nozzle 6. Thus, in normal delivery operation, the thread 1 is located at least in a partial area of the suction nozzle 6. This facilitates, for example, upon a thread breakage with which the thread end is wound onto the bobbin 3, the rapid finding of the thread end and the re-attachment to a new thread. The thread 1 is pulled out from the spinning position 2 by means of delivery rollers 7 and is wound up by the bobbin 3.

A swivel-mounted holder 10 is arranged outside of the run of the thread 1. An eyelet 11 and a seal 12 are located on the holder 10. In a later step of the method, the eyelet 11 is used to form a thread loop. In normal spinning or delivery operation, the eyelet 11 is inoperable. An extraction port 8 may be switched on, but in the normal case is switched off to save energy.

FIG. 1*b* shows the position of the holder 10 upon a thread breakage. A thread end is located on the surface of the bobbin 3. In the suction nozzle 6, negative pressure is applied by means of the extraction port 8, in order to find the thread end on the bobbin 3. In the suction nozzle 6, the eyelet 11 is swung in by means of the holder 10. The opening 5 is sealed by means of the seal 12. Thus, the suction nozzle 6 forms a closed suction channel.

FIG. 1*c* shows the finding of a thread end 13 of the thread 1. Herein the thread 1 is threaded through the eyelet 11. The bobbin 3 rotates counter to the spooling direction of FIG. 1*a*. Thus, the thread 1 is unwound from the bobbin 3, and is guided into the extraction port 8 following the suction nozzle 6.

Figures 1D, 1E, 1F, 1G:
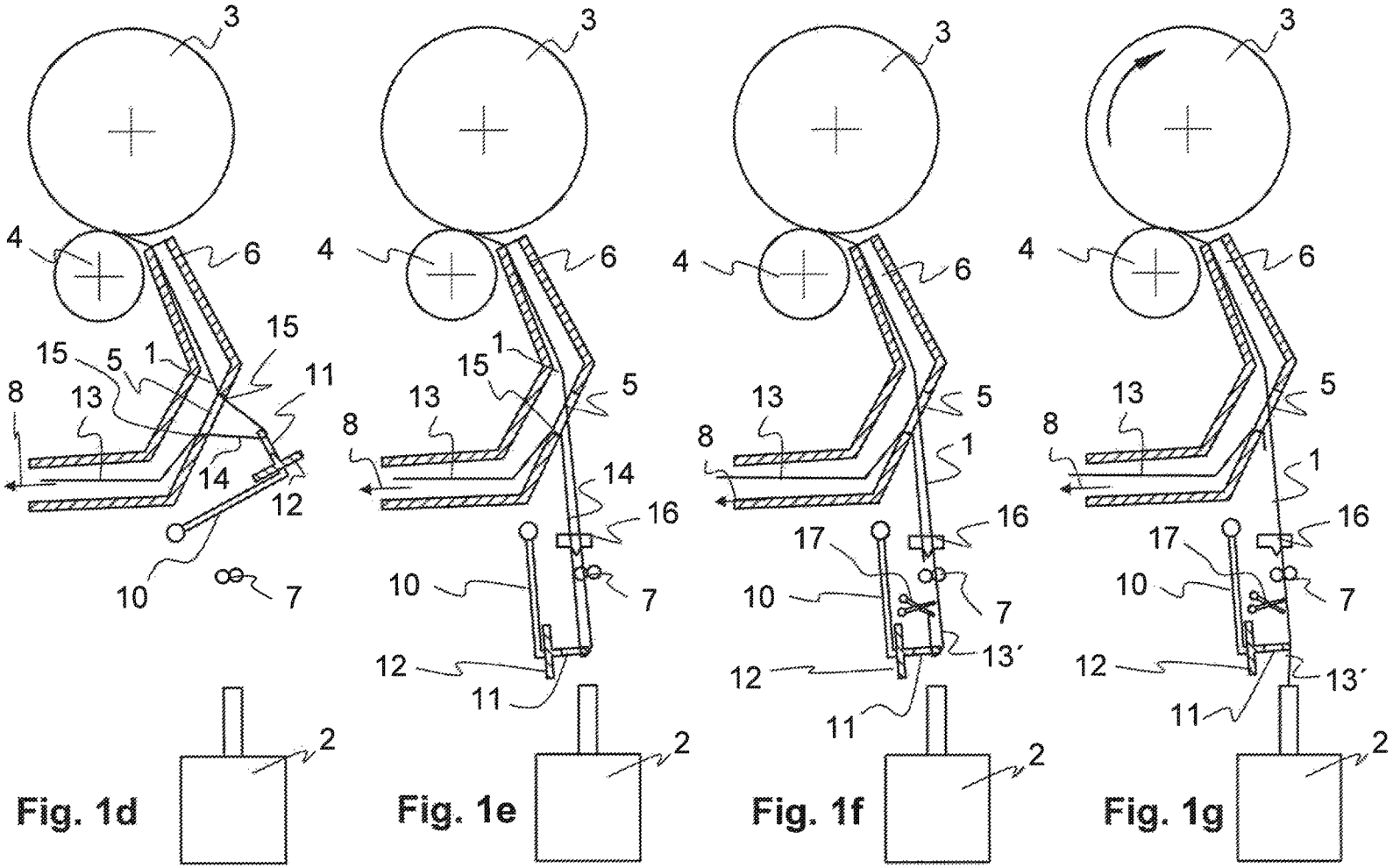
FIG. 1*d* depicts the formation of a loop.
FIG. 1*e* depicts the loop in front of the spinning position.
FIG. 1*f* depicts the separation of the loop.
FIG. 1*g* depicts the re-attachment of the thread.

In accordance with FIG. 1*d*, the holder 10 once again moves, together with the eyelet 11, out of the suction nozzle 6. Thereby, the thread 1 forms a loop 14 between the bobbin 3 and the extraction port 8. In this case, the thread 1 is pulled through the edges 15 of the opening 5. Thus, it already forms a first defined shape of the loop 14. The thread end 13 continues to be pulled in by the extraction port 8. Thus, between the bobbin 3, the eyelet 11 and the extraction port 8, the thread 1 is stretched taut.

Through a further movement of the holder 10 in the direction of the spinning position 2, the loop 14 is stretched in a manner corresponding to FIG. 1*e*. In order to prevent the thread segment going to the bobbin 3 and the thread segment running into the extraction port 8 from contacting each other, a spacer 16 is provided. The spacer 16 separates the two thread segments and keeps them spaced apart from each other. The spacer 16 also brings about the fact that the thread 1 does not come into contact with components of the machine and thereby does not disrupt the further treatment of the thread.

FIG. 1*f* shows the separation of the thread 1. A separating device 17, such as a knife or scissors, cuts the thread 1. The thread end 13 is subsequently sucked into the extraction port 8 and disposed of. The newly created thread end 13' now features a defined length and may be fed, for example, to a thread preparation device (not shown), in order to feature an optimal structure of the thread end 13' for the re-attachment to a new thread. The thread preparation may take place at such point in time or even later.

In accordance with FIG. 1*g*, the thread end 13' is then inserted into the spinning position 2 and is used for the re-attachment of the thread. This occurs by the fact, for example, that negative pressure prevails in the spinning position and sucks in the thread end 13' falling out of the eyelet 11. The thread end 13 is then finally extracted by suction. The holder 10 may thereafter be swiveled back to the original position in accordance with FIG. 1*a*.

The thread 1 delivered to the bobbin 3 is held in a predetermined position by means of the spacer 16 and is once again fed to the bobbin 3 through the opening 5. The pulling off of the thread 1 from the spinning position 2 in turn takes place by means of the delivery rollers 7, between which the thread 1 is then once again clamped. The clamping of the thread 1 between the delivery rollers 7 may take place at this point, or as early as the point in time of FIGS. 1*e* and 1*f*.

Figure 2:
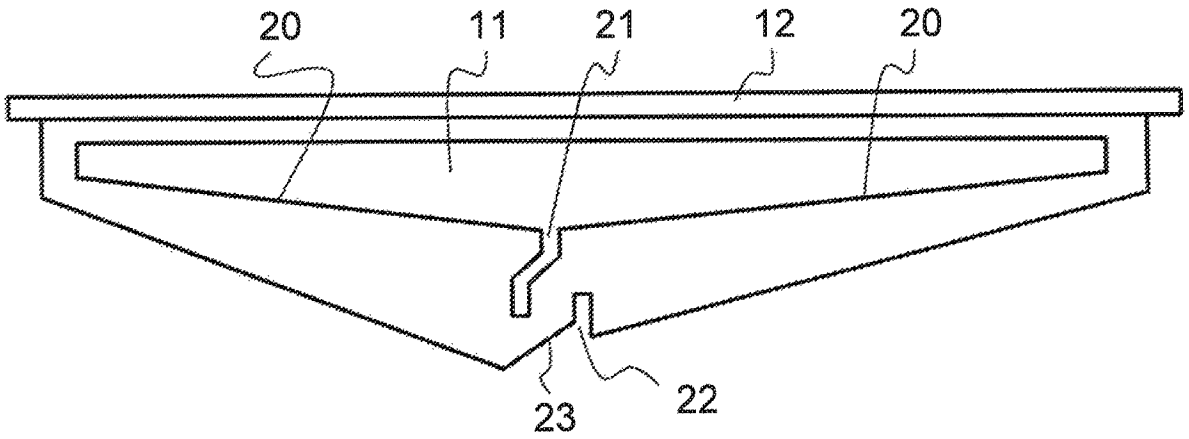
FIG. 2 depicts an eyelet with thread guides.

In FIG. 2, the eyelet 11 with the seal 12 is shown in greater detail. The eyelet 11 extends along the seal 12. In the swung-in state, the eyelet 11 is located completely inside the suction nozzle 6 in accordance with FIGS. 1*b* and 1 *c*. The thread, which may come to lie at any point in the axial direction of the bobbin 3, is sucked through the longitudinally extending eyelet 11. When swiveling the eyelet 11 by means of the holder 10 (FIGS. 1*c*, 1*d* and 1*e*), the thread 1 is moved along inclined guides 20 initially in the direction of a groove 21. The thread 1 is herein trapped in the groove 21. Thereafter, through the swiveling movement of the eyelet 11, the thread 1 is formed into a loop 14, whereas the one part of the thread 1 comes to lie in the groove 21 and the other part of the thread comes to lie in a groove 22 outside of the eyelet 11. Thus, in the internally arranged groove 21, the guide is located for the defective thread; that is, for the thread end 13 that is extracted by suction later in the extraction port 8. The good thread, that is, the thread end 13' that is used for re-attachment and is later wound onto the bobbin 3, lies in the externally arranged groove 22. In order to be able to securely catch the good thread, which is wound onto the bobbin 3, in the groove 22, a guide 23 is provided; this directs the thread coming from the groove 21 into the groove 22.

Figure 3:
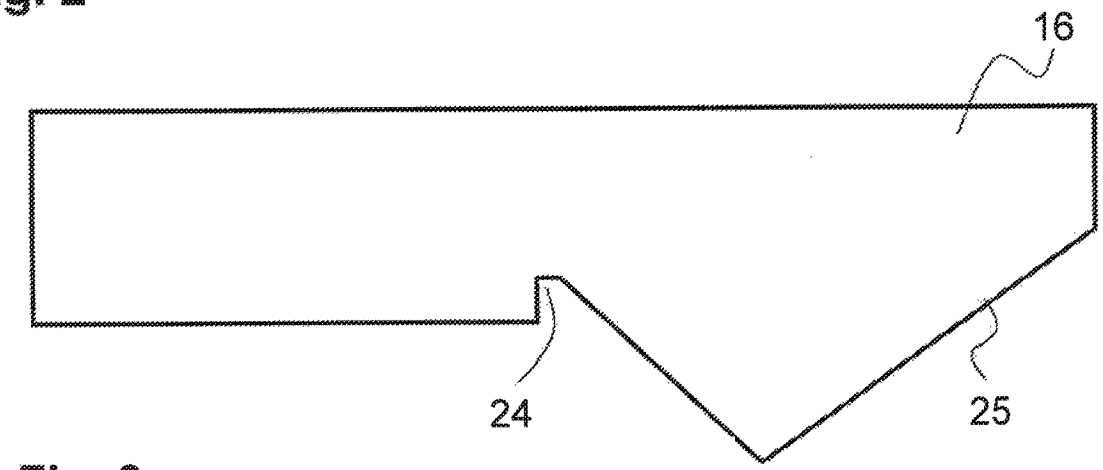
FIG. 3 depicts a thread guide.

FIG. 3 shows a spacer 16. The spacer 16 features a groove 24 for guiding the defective thread, which is to be discharged into the extraction port 8. For guiding the other side of the thread loop 14, a guide 25 is provided on the spacer 16. Through this guide 25, on the one hand, the separation between the good thread and the defective thread is brought about and, on the other hand, the guide 25 serves as a sliding surface for the good thread, in order to be able to arrive in the normal run of the thread no later than after re-attachment. Such spacers 16 adjusted to the place of use in a form corresponding to the requirements may be arranged repeatedly in the run of the thread, and, depending on the need, may bring about at various places that the loop 14 remains stretched.

Figure 4C:
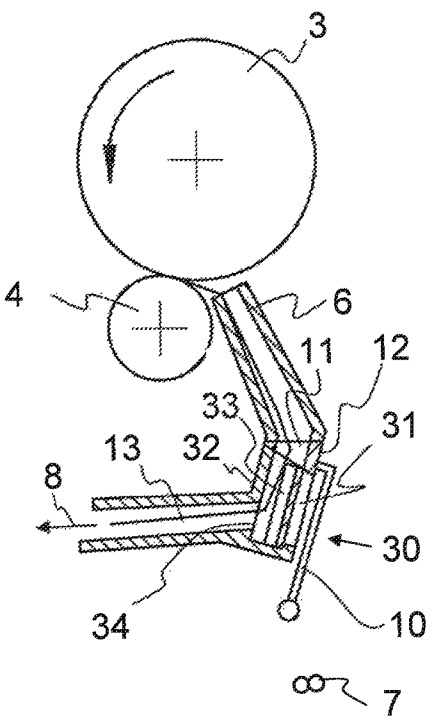
FIG. 4*c* depicts a thread threaded into the eyelet.
Figure 4C:
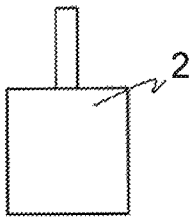
Figure 4B:
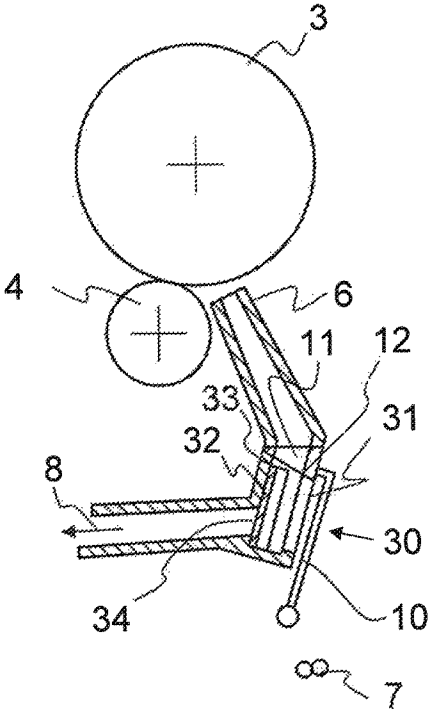
FIG. 4*b* depicts an eyelet swung into the suction nozzle.
Figure 4B:
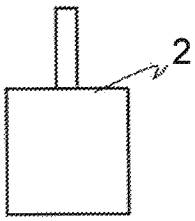
Figure 4A:
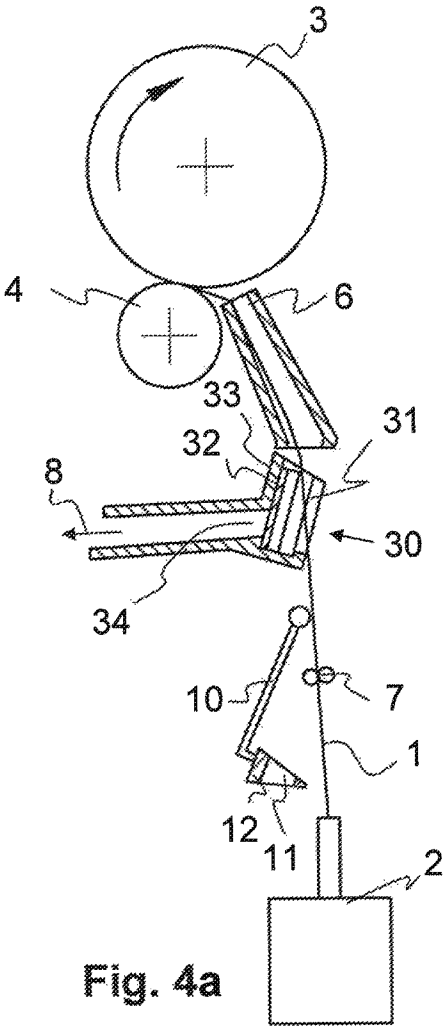
FIG. 4*a* depicts the delivery of a thread from a spinning position to a bobbin.

FIG. 4*a* shows an additional version of the present invention. Comparable components are provided with the same reference signs as in FIGS. 1*a* to 1*g*. In this embodiment, a multi-valve 30 is arranged in the area of the suction nozzle 6. The thread 1 proceeds through a slot 31 of the multi-way valve 30 into the suction nozzle 6, and from there is wound by means of the winding roller 4 onto the bobbin 3. The holder 10 with the eyelet 11 is swiveled out of the run of the thread. In this embodiment, the eyelet 11 is designed differently than in the previous embodiment. In the cross-section transverse to the thread running direction, it is formed in a ring shape, and in a side view in a wedge shape.

A gap in which the eyelet 11 is later inserted is located between the extraction port 8 and the suction tube 6. The multi-valve 30 comprises two tubes 32 and 33 that are fitted into one another, are rotatable and feature slots. The inner tube 33 is solely a tube section, as is explained in more detail in FIG. 5. Thus, the slot extends over a large part of the circumference of the tube 33. The outer tube 32 of the multi-way valve 30 features a suction port 34, which leads to the extraction port 8. In FIG. 4*a*, the position of the tube 33 is such that the suction port 34 is blocked. Thus, the extraction port 8 is inactive.

FIG. 4*b* shows the situation when the thread breaks. The thread is wound onto the bobbin 3. The holder 10 is swiveled upwards and, with the ring-shaped seal 12, closes the gap between the suction nozzle 6 and the multi-valve 30. The extraction port 8 is still closed by the tube section 33. The eyelet 11 follows the suction nozzle 6 and the multi-valve 30.

For finding the thread end 13 on the bobbin 3, in accordance with FIG. 4*c*, the bobbin 3 rotates counter to the normal delivery direction. The inner tube 33 is now rotated in such a manner that the slot 31 is closed and, on the other hand, the suction port 34 is open. The extraction port 8 is thereby activated, and the thread end 13 is sucked in through the multi-valve 30 into the extraction port 8.

After the thread end 13 has been found, the holder 10 moves back down, and thereby opens the gap between the suction nozzle 6 and the multi-valve 30. In addition, the inner tube 33 is rotated again, such that the slot 31 is opened, but the suction port 34 remains open and the extraction port 8 remains active. It forms a thread loop 14, which passes through the slot 31 of the multi-valve 30 and thus already has a certain position. The thread loop 14 is stretched by the extraction port 8, which attempts to extract the thread end 13 by suction. The bobbin 3 may still move against the normal delivery direction and thus track the thread 1. However, it is also possible that, upon the formation of the loop 14, thread 1 from the extraction port 8 is pulled back.

Figures 4D, 4E, 4F, 4G:
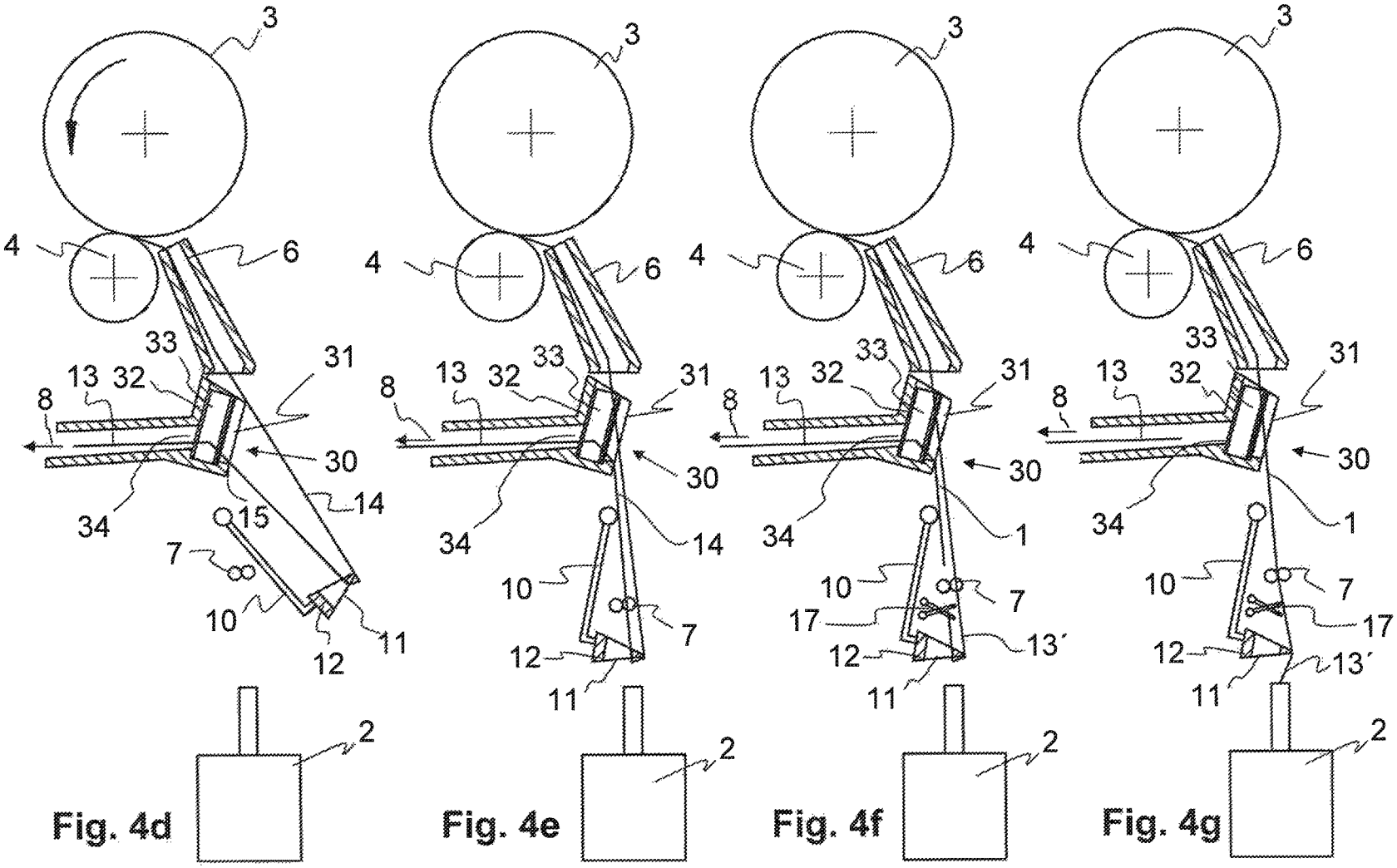
FIG. 4*d* depicts the formation of a loop.
FIG. 4*e* depicts the loop in front of the spinning position.
FIG. 4*f* depicts the separation of the loop.
FIG. 4*g* depicts the re-attachment of the thread.

In FIG. 4*e*, the holder 10 is located with the eyelet 11 in the area of the spinning position 2. The thread loop 14 is stretched and then proceeds completely through the slot 31. Spacers 16, as described in FIG. 3, may likewise be arranged here in order to keep the thread loop 14 open. However, they are not shown here.

In FIG. 4*f*, the thread loop 14 is severed by means of the separating device 17. The thread end 13 is sucked into the extraction port 8. The new thread end 13' is available for thread preparation.

In FIG. 4*g*, the thread end 13' is sucked into the spinning position 2, and the production of the thread 1 can begin again. The holder 10 may eventually be swiveled back into the original position in accordance with FIG. 4*a*. The inner tube 33 may thereupon once again close the suction port 34, such that energy is saved, because, at such moment, the extraction port 8 is not required.

Figure 5A:
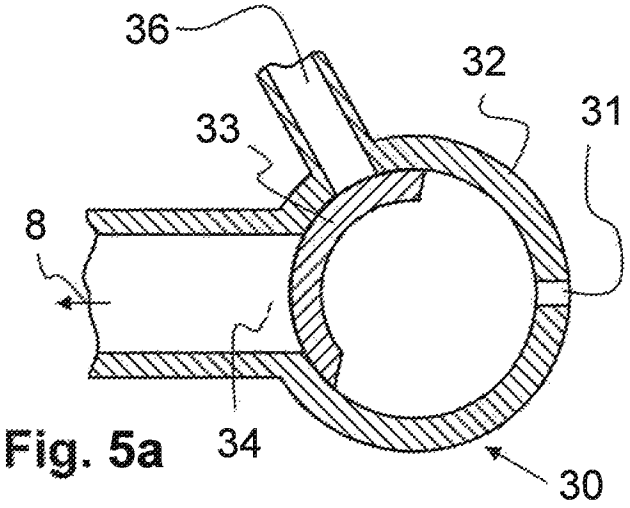
FIG. 5*a* depicts a multi-valve in spinning position.

FIG. 5*a* shows a section through the multi-valve 30. It can be seen from this that the multi-valve 30 features an outer tube 32 and an inner tube 33. The inner tube 33 is only a tube section, which is rotatably mounted with respect to the tube 32. The suction port 34 is arranged at the outer tube 32; this leads into the extraction port 8. In addition, an additional suction port 36 is provided in the outer tube 32. The suction port 36 may serve the purpose of picking up a thread loop upon spinning, in order to be able to carry out any required length compensation. In this case a thread loop is more or less sucked into the suction port 36 and sucked out from it when needed.

In FIG. 5*a*, the inner tube 33 is shown in a position in which both suction ports 34 and 36 are closed. Only the slot 31 of the tube 32 is open. Through this slot 31, with normal delivery, the thread runs from the spinning position 2 to the bobbin 3. This position corresponds to FIGS. 4*a* and 4*b*.

Figure 5B:
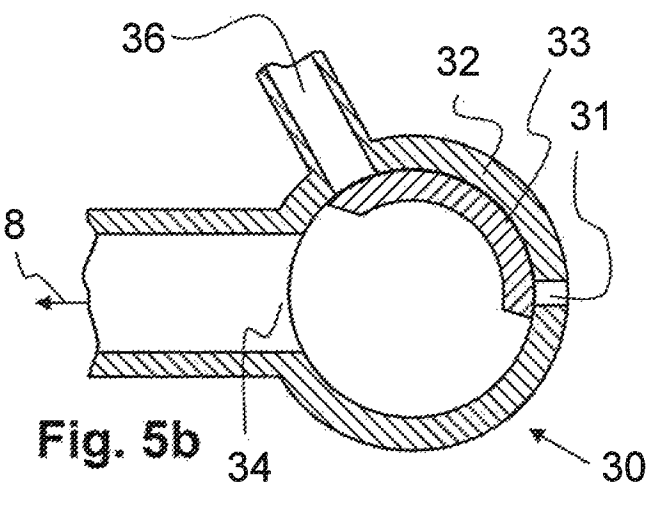
FIG. 5*b* depicts the multi-valve in a thread extraction position.

In FIG. 5*b*, compared to FIG. 5*a*, the tube 33 is rotated. In this position, the suction port 34 is opened, while the suction port 36 and the slot 31 are closed. This position is occupied for seeking out the thread end on the bobbin 3, and the extraction by suction of the thread end 13 into the extraction port 8 (see FIG. 4*c*).

Figure 5C:
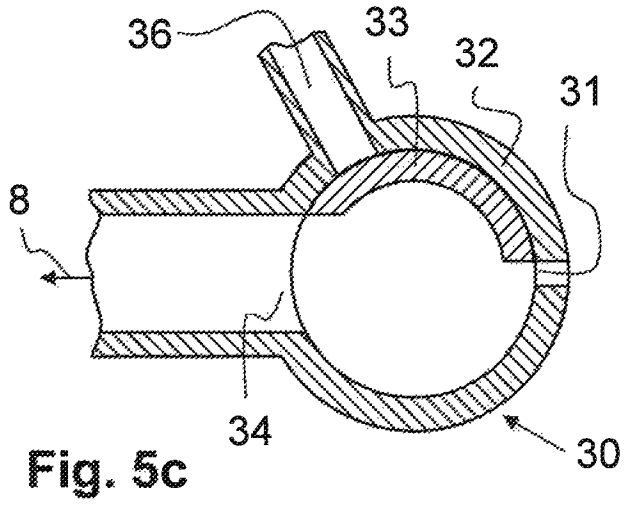
FIG. 5*c* depicts the multi-valve in a position to form a loop upon re-attachment.

In FIG. 5*c*, the tube 33 is in turn somewhat rotated. This position closes the suction port 36, but opens the suction port 34 and the slot 31. In this position of the tube 33, the loop 14 is formed (FIGS. 4*d* to 4*g*).

Figure 5D:
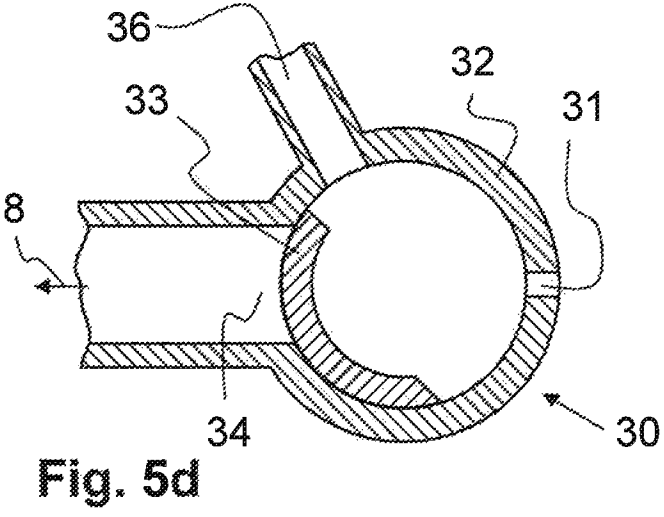
FIG. 5*d* depicts the multi-valve in a position to form a thread loop in the normal run of the thread.

FIG. 5*d* shows a closed suction port 34. The slot 31 and the suction port 36 are open. In this position, a thread loop is formed in the suction port 36; this can be used for length compensation upon winding on the thread 1 onto the bobbin 3.

Figure 6:
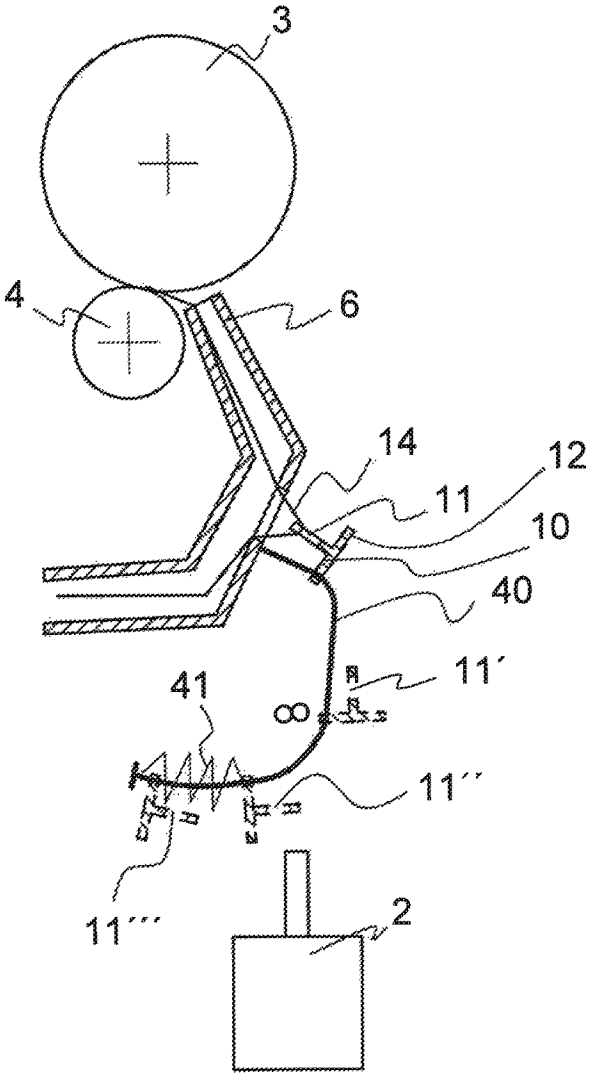
FIG. 6 depicts an eyelet introduced into the suction nozzle.

FIG. 6 shows the movement of the eyelet 11 along a guide 40. Thus, a circular swiveling movement of the eyelet 11 is not required, by which installation space can be saved. Thus, the movement of the eyelet 11 may be guided nearly arbitrarily in accordance with the available installation space at the work location. Some of the different positions of the eyelet 11 are shown hatched with the reference signs 11', 11" and 11'". Here, the holder 10 is integrated with the seal 12. However, this represents only a schematic representation of the version.

Together with the holder 10 and the seal 12, the movement of the eyelet 11 may take place, for example, by means of a Bowden cable (not shown), which pushes or pulls the eyelet 1, the holder 10 and the seal 12 along the guide 40. A shutter may also be connected to the eyelet; this is formed, for example, as a bellows or as a type of toggle chain. This shutter may be moved together with the eyelet 11, and may cover the work area if the eyelet 11 is located in the area of the suction nozzle 6. In the end position, the shutter may once again free the work area. In the position of the eyelet 11", such a shutter is indicated in an almost folded up state.

This invention is not limited to the illustrated and described embodiments. Variations within the scope of the claims, just as the combination of characteristics, are possible, even if they are illustrated and described in different embodiments.

LIST OF REFERENCE SIGNS

1 Thread
2 Spinning position
3 Bobbin
4 Winding roller
5 Opening
6 Suction nozzle
7 Delivery rollers
8 Extraction port
10 Holder
11 Eyelet
12 Seal
13 Thread end
14 Loop
15 Edge
16 Spacer
17 Separating device
20 Guide
21 Groove
22 Groove
23 Guide
24 Groove
25 Guide
30 Multi-valve
31 Slot
32 Outer tube
33 Inner tube
34 Suction port
36 Suction port
40 Guide
41 Shutter

The invention claimed is:

1. A method for operating a textile machine to extract a thread by suction from a bobbin and for re-attachment of a thread end of the thread to a new thread, the method comprising:

extracting the thread from the bobbin by sucking the thread in against its spooling direction on the bobbin through a suction nozzle and into an extraction port of an extraction system;

subsequently forming a loop in the thread;

separating the thread in the area of the loop, and discharging one thread end into an extraction port;

preparing the other thread end coming from the bobbin for re-attachment to a new thread; and wherein upon being extracted by suction into the extraction system, the thread is guided through an eyelet located in a run of the thread to the extraction port and the eyelet, together with the thread, is moved out of the run of the thread to the extraction port such that the thread forms the loop between the bobbin, the eyelet, and the extraction port.

2. The method according to claim 1, wherein the movement of the eyelet is produced through a swiveling movement or a displacement along a guide.

3. The method according to claim 1, wherein during the extracting of the thread by suction, the eyelet seals the suction nozzle.

4. The method according to claim 1, wherein in forming the loop, the thread is pulled over at least one edge.

5. The method according to claim 4, wherein during the extracting of the thread by suction through the eyelet, the eyelet is located on one side of the edge, and during the forming of the loop, the eyelet is located on the other side of the edge.

6. The method according to claim 1, wherein the thread is guided by the eyelet into at least one predetermined position transverse to the movement of the eyelet.

7. The method according to claim 6, wherein upon the extracting of the thread by suction, the eyelet guides the thread into a first position, and, upon forming the loop, moves the thread into a second position.

8. The method according to claim 1, wherein the thread is guided adjacent to the eyelet through a multi-way valve for forming the loop upon the extracting of the thread or upon the re-attachment of the thread.

9. The method according to claim 1, wherein Immediately after separation of the thread, the thread end coming from the bobbin is clamped between delivery rollers.

10. The method according to claim 1, wherein upon the extracting of the thread by suction from the bobbin and upon delivery of the thread to the bobbin, the thread is guided through the suction nozzle.

11. A system in a textile machine for extracting a thread by suction from a bobbin and for re-attaching a thread end a new thread, comprising:

a suction nozzle configured to pick up the thread from the bobbin;

an extraction port of an extraction system, the extraction port in communication with the suction nozzle to extract the thread by suction through the suction nozzle counter to a spooling direction of the thread on the bobbin;

a device that forms a loop in the thread extracted from the bobbin;

a thread separating device disposed at a location to separate the thread in the area of the loop to create the thread end for subsequent re-attachment;

a thread preparation device that prepares the thread end for re-attachment; and wherein the device that forms the loop further comprises an eyelet arranged in a run of the thread to the extraction port, wherein the thread is guided through the eyelet upon being extraction by suction;

the eyelet arranged on a movable holder; and wherein the eyelet, together with the thread, is movable out of the run of the thread to the extraction port such that the thread forms a loop between the bobbin, the eyelet, and the extraction port.

12. The system according to claim 11, wherein the holder with the eyelet is mounted to be swiveled or displaced.

13. The system according to claim 12, wherein holder is slidably guided.

14. The system according to claim 11, wherein the eyelet is movable to a position to seal an opening in the suction nozzle during the extracting of the thread by suction.

15. The system according to claim 11, further comprising an edge disposed so that the thread runs over the edge during formation of the loop.

16. The system according to claim 15, wherein during the extracting of the thread by suction through the eyelet, the eyelet is located on one side of the edge, and during the forming of the loop, the eyelet is located on the other side of the edge.

17. The system according to claim 11, wherein the eyelet comprises one or more guides disposed to contact and guide the thread into at least one predetermined position transverse to movement of the eyelet.

18. The system according to claim 11, wherein one of the guides is arranged on an inner side of the eyelet, and another of the other guides is arranged on an outer side of the eyelet.

19. The system according to claim 11, further comprising a multi-way valve in communication with the extraction port is arranged adjacent to the eyelet for forming the loop upon extraction of the thread by suction.

20. The system according to claim 11, wherein the multi-way valve comprises a first tube that is rotatable within a second tube to place the multi-way valve into different operating positions.

21. The system according to claim 20, wherein the outer tube comprises at least one suction port.

22. The system according to claim 21, wherein the suction port is disposed to pick up the thread from the bobbin upon the extraction of the thread by suction.

23. The system according to claim 20, wherein the multi-way valve comprises a slot through which the thread runs upon delivery of the thread to the bobbin.

* * * * *